United States Patent [19]

Smith et al.

[11] 4,249,386

[45] Feb. 10, 1981

[54] APPARATUS FOR PROVIDING RADIATIVE HEAT REJECTION FROM A WORKING FLUID USED IN A RANKINE CYCLE TYPE SYSTEM

[76] Inventors: Phyllis S. Smith; Otto J. M. Smith, both of 612 Euclid Ave., Berkeley, Calif. 94708

[21] Appl. No.: 916,135

[22] Filed: Jun. 16, 1978

[51] Int. Cl.[3] ..... F28B 1/00; F28B 7/00

[52] U.S. Cl. ..... 60/693; 60/655; 60/641; 165/DIG. 5; 165/110; 165/133; 126/901

[58] Field of Search ..... 165/133, DIG. 5, 110; 62/467, DIG. 1; 60/641, 690, 692, 693; 126/901

[56] References Cited

U.S. PATENT DOCUMENTS

| | | | |
|---|---|---|---|
| 2,968,916 | 1/1961 | Taylor et al. | 60/641 |
| 2,998,006 | 8/1961 | Johnston | 126/901 X |
| 3,043,112 | 7/1962 | Head | 62/56 |
| 3,270,515 | 9/1966 | Telbes | 62/467 X |
| 3,285,333 | 11/1966 | Johnson, Jr. | 165/133 |
| 3,310,102 | 3/1967 | Trombe | 62/467 X |

*Primary Examiner*—Albert W. Davis

*Attorney, Agent, or Firm*—Flehr, Hohbach, Test, Albritton & Herbert

[57] ABSTRACT

Radiative heat rejection for the condensate of a steam system in which panels painted with titanium dioxide are put out in the desert and water as a heat exchange fluid is flowed on the underside of the panels. They will radiate into the night sky and produce significant cooling and provide for rejection of condenser heat from Rankine cycle water and steam turbines as well as reflect the sun. In addition to titanium dioxide panels one can use reversible plastic mattresses floating on a cool pond coated black on one side and silver on the other and with the black surface up at night, silver surface up in the daytime; they too will provide radiative heat rejection.

6 Claims, 5 Drawing Figures

APPARATUS FOR PROVIDING RADIATIVE HEAT REJECTION FROM A WORKING FLUID USED IN A RANKINE CYCLE TYPE SYSTEM

BACKGROUND OF THE INVENTION

The present invention is directed to apparatus for providing radiative heat rejection from a working fluid used in a Rankine cycle type system.

In Rankine cycle systems temperature difference across the thermodynamic system is a criterion of Carnot efficiency. Cooling the condensate of a steam turbine is very difficult in a desert environment. Such desert power plants will become common as solar energy techniques are developed.

OBJECTS AND SUMMARY OF THE INVENTION

It is, therefore, an object of the present invention to provide apparatus for providing radiative heat rejection from a working fluid used in a Rankine cycle type system.

Accordingly, there is provided apparatus for radiative heat rejection from a working fluid used in a Rankine cycle type system. Fluid retention means provide a relatively large fluid radiating surface with respect to its height. Interface means between the large surface of the fluid and the sky reflect visible light during the day and radiate infrared energy from the fluid.

DETAILED DESCRIPTION OF THE PREFERRED EMBODIMENTS

Figure 1:
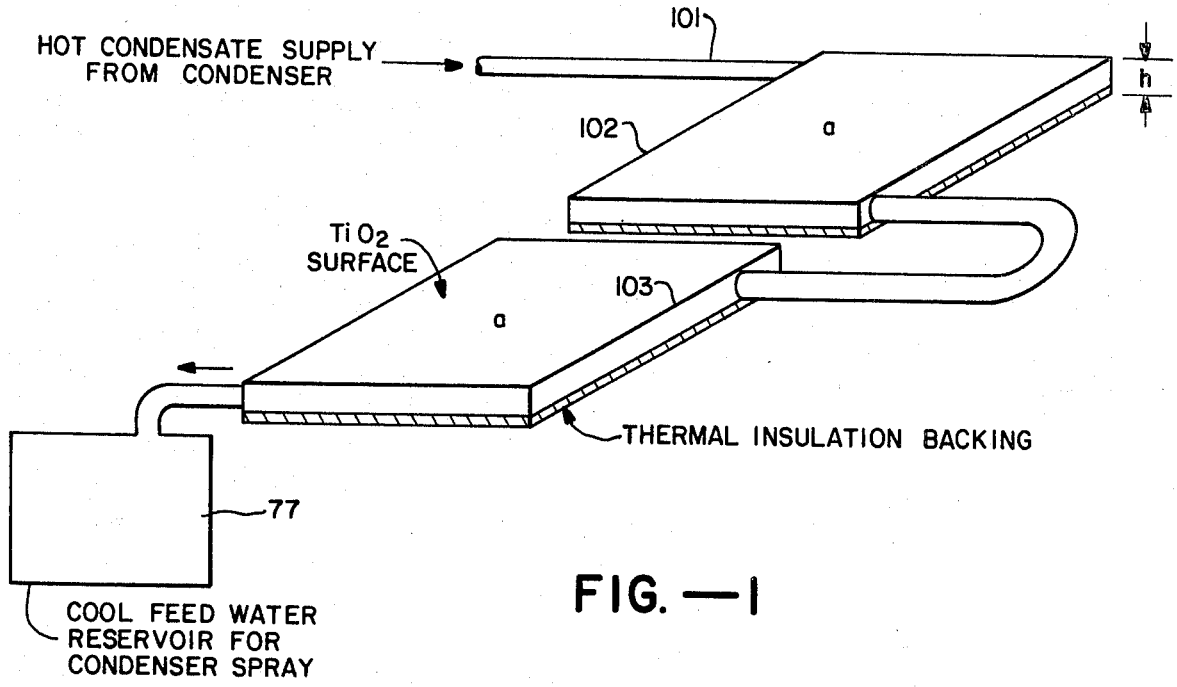
FIG. 1 is a perspective view of one embodiment of the invention.

FIG. 1 shows a pair of panels 102, 103 out in the desert which lay flat on the ground and have a horizontal surface which can radiate electromagnetic energy in equilibrium with the sky. The panels can be made of metal such as iron or aluminum and will be formed like boxes with a very small vertical height, h, and very large horizontal area, a. The area is painted with titanium dioxide, a white house paint which has the following electromagnetic properties. For visible light it appears to have the color white and is a good reflector of visible light. For infrared light it appears to have the color black and is a good absorber and radiator of infrared energy. There might be other materials which would have similar type properties. The criteria is they must be white or mirror-like for visible light and they must be black or absorbers for infrared light. It is the property of this surface used in conjunction with the geometry of the large flat panels laid out in the desert that produces the thermal equilibrium condition that these panels during the daytime absorb relatively little energy from the sun but simultaneously they will be radiating energy into the apparent temperature of the sky and this radiative power flow is proportional to the fourth power of the temperature of the panels. The net interchange of energy is such that the panels will deliver into the daytime sky a significant amount of infrared energy. At night without sunshine falling on the panels they will radiate into the night sky and will deliver even more infrared energy than during the daytime. The purpose of delivering this energy into the night sky is that we wish to reject the condenser heat from the hot condensate which is obtained from the condensers shown in the two copending patent applications, Ser. Nos. 737,489 and 717,641, filed Nov. 1, 1976, and Aug. 25, 1976, respectively and now U.S. Pat. Nos. 4,117,682 and 4,164,123, respectively. This hot condensate must be cooled off in order to provide the cool feed water in the cool feed water reservoir 77 in the two copending U.S. patent applications and this cool feed water is used for the condenser spray in these applications. To provide this effect, therefore, the hot condensate is delivered in a pipe 101 to the box 102 out in the desert. This is an enclosed flat reservoir and it then flows out of this reservoir into a second box 103 and out of this second box it eventually flows into the cool feed water reservoir 77.

Actually units 102, 103 are representative only. There would be hundreds of these units in the desert for a 50 megawatt base load plant dissipating approximately 150 megawatts thermal on the average for 24 hours per day. An area of approximately 150 acres would be suitable and these 150 acres would dissipate the 150 megawatts thermal with an average equilibrium temperature for the water exiting from these panels of approximately 10° C. in the winter and approximately 30° C. in the summer. The water should be in thermal contact with the metal which has been coated with a titanium dioxide paint to provide a low temperature difference between the water and this cooling surface.

The boxes 102, 103 are completely enclosed. It is a closed system and the water is not permitted to vaporize.

The foregoing technique has general application to all Rankine cycle power plants and would have very important application to coal fired power plants located in desert areas such as the Four Corners power plant in the USA. It also would have very important application to bottoming cycle organic fluid Rankine cycle systems such as ammonia, toluene, freon, or propane turbines in which the working fluid is boiled by low temperature flat plate solar collectors and would be condensed and the working fluid after exiting from the turbine would be condensed by the lowest possible temperature which you could achieve in the desert. This lowest possible temperature could be obtained from these titanium dioxide panels in which the heat exchange fluid on the underside of the panel in the boxes is either water or the turbine working fluids specified above. Such system will be discussed below in conjunction with FIG. 5.

Titanium dioxide surfaces were first used for houses because as a house paint they will keep the house cooler and therefore the wood and the paint has longer life. They are now used industrially for coating radar domes and for painting the structures on radio telescopes such that they will not distort under the influence of changes of radiation such as the change between sunshine and shade which can seriously disturb the dimensional stability of telescopes of all kinds and of the structures for radar installations. Thus it is known to be a valuable paint to use for metals that are exposed to sunshine. But no one has used it in the environment of the present invention.

In FIG. 1, there is shown underneath the boxes carrying the heat exchange fluid in the desert a thermal insulation backing. The purpose of this is to prevent the ground and the air below these panels, both of which might be at relatively high desert temperatures, from delivering energy to the heat exchange fluid in the piping system. If the ground and the air were significantly cooler than the coldest fluids in these tanks, then the thermal insulation backing should be omitted. But in the event that the ground and air temperatures influencing the temperature at the bottom side of these panels is greater than the coolest water temperature than the thermal insulation backing should be used.

Figure 2:
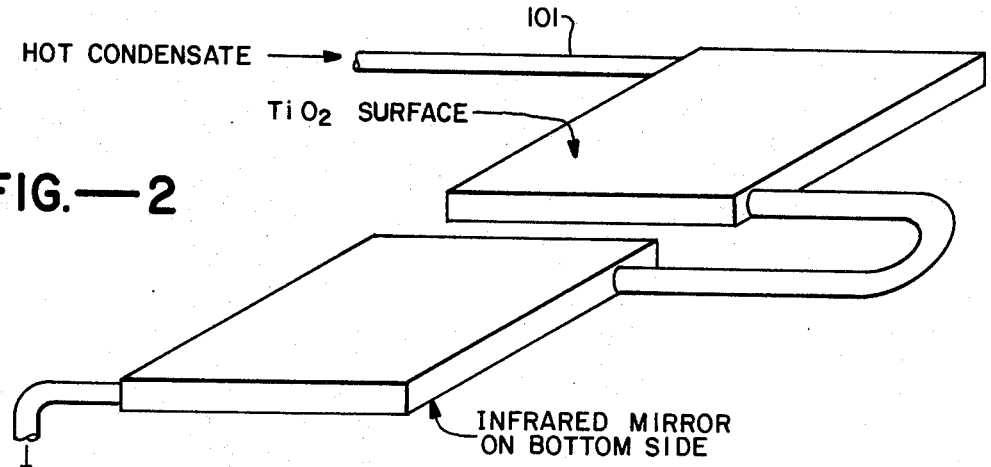
FIG. 2 is a perspective view of another embodiment of the invention.

FIG. 2, is an alternate method of backing the panels in the desert. In this case, instead of using thermal insulation backing, an infrared mirror is used on the bottom side. This infrared mirror can be as simple as aluminum sheets or aluminum foil or any material which has a mirror-like characteristic in the very long wavelength infrared; that is, the very low temperature infrared which is produced by ground temperatures of 100° to 200° F.

Figure 3:
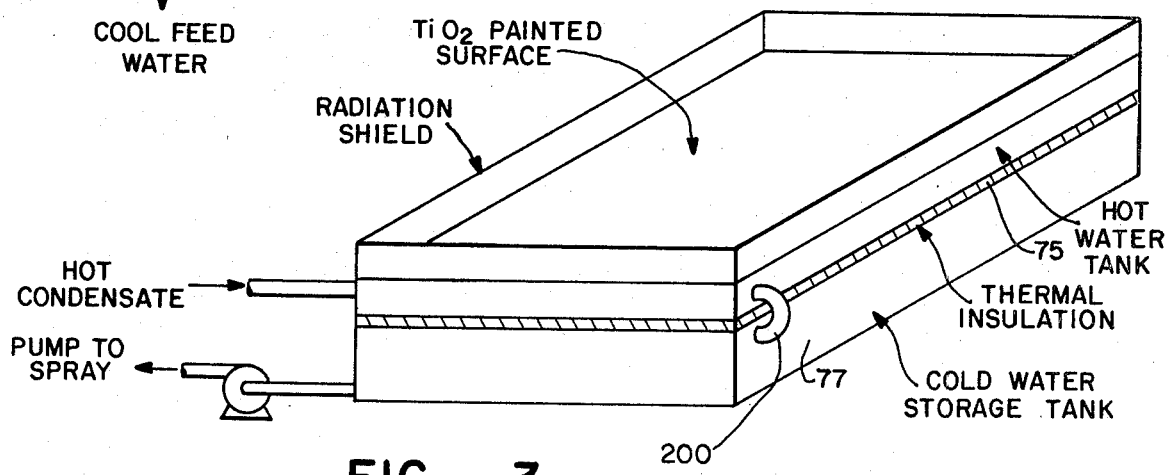
FIG. 3 is a perspective view of another embodiment of the invention.

In FIG. 3, there is shown a combination of the cool feed water reservoir and the radiative surface shown in FIG. 1. The radiative surface and its panels are mounted directly above a secondary cold water storage tank 77 with insulation 75 between the two. The hot cndensate from a condenser 74 enters the top box, radiates energy into both the daytime and night time sky and when it is cooled it passes through pipe 200 into the lower box 77 where it is stored as cold water and is available to be pumped by pump 78 to the spray of the condenser. The combination of these two can provide desirable savings in cost of construction by using the same structural foundation for both items.

Also shown in FIG. 3 is a radiation shield which extends slightly above the titanium dioxide surface around the edges of the painted panel. Thus the surface is recessed. The purpose of this is to shield from the painted surface the view of adjacent trees or mountains. These structures or objects which are near the ground will have temperatures significantly higher than the temperature of the night sky or free space. Consequently, the equilibrium energy interchange between the titanium dioxide surface and mountains or trees which could be visible to this surface is such that a significantly lessor amount of energy would be delivered from the surface to the mountains that would be delivered from the surface to the sky. By providing a reflecting radiation shield around the edge, the titanium dioxide surface is permitted to view only the night sky and this will give superior heat rejection capabilities.

The radiation shield may be of any material that has a mirror-like property for the long wavelength infrared which is the infrared obtained from low temperature sources.

Figure 4:
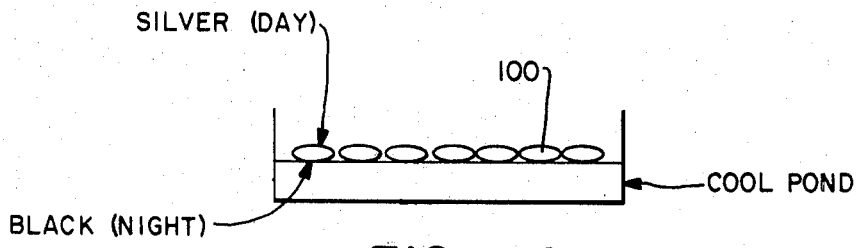
FIG. 4 is an elevation view of another embodiment of the invention.

FIG. 4 illustrates another embodiment of the invention where a cooling pool has reversible plastic mattresses 100 floating on its surface. One side is coated silver to reflect visible light; at night they are flipped and a black surface provides radiation of infrared energy. Alternatively, of course, the panels of mattresses could be coated with titanium dioxide and therefore would not need to be turned once a day.

Figure 5:
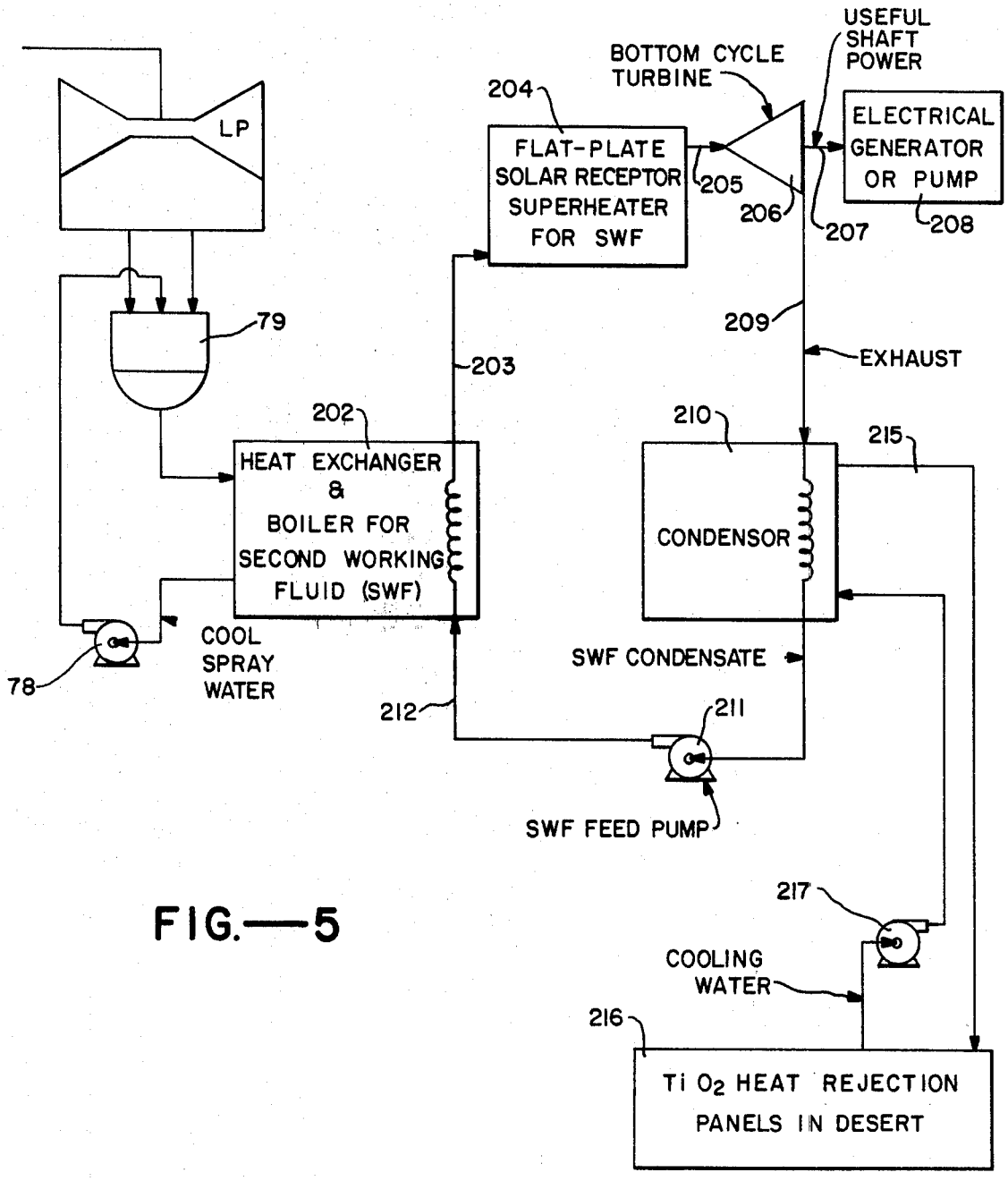
FIG. 5 is a block diagram of a bottoming cycle system in combination with the present invention.

FIG. 5 is the flow chart for a bottoming cycle system using a secondary working fluid or a secondary Rankine turbine. The condensate from condenser 79 passes through pipe 201 to a heat exchanger 202 where this water condensate is cooled. It exits from 202 on the pipe called cool spray water and goes back to pump 78 to be available for spray water in the condenser 79. The heat exchanger 202 provides a dual function of extracting heat energy from the water which was used in the main turbines and becomes a boiler for the second working fluid of the low bottoming cycle. This boiler delivers a vapor on pipe 203 which goes to flat plate solar receptors 204 which function as superheaters for the second working fluid. The superheated second working fluid exits on pipe 205 to the turbine 206 called the bottoming cycle turbine. This turbine extracts energy from the second working fluid and delivers this as useful shaft power on shaft 207 to a load 208 which can be an electrical generator synchronized to the power system or can be a pump for the purpose of pumping water or doing other useful mechanical work. The output of the bottoming cycle turbine 206 is the exhaust gas in pipe 209 at very low pressure and temperature. This exhaust gas is condensed in condensor 210 and produces a secondary working fluid (SWF) liquid condensate which is then pumped by feed pump 211 to bring it back up to the necessary working pressure such that it will boil at the temperatures available in the heat exchanger 202. The closed secondary working fluid cycle consists therefore of feed pump 211, pipe 212, boiler 202, pipe 203, superheater 204, gas header to the throttle 205, turbine 206, exhaust 209 and condenser 210.

The heat energy from the foregoing thermodynamic cycle must be rejected. This heat energy consists of all of the heat removed from the water condensate plus all of the heat harvested by the flat plate receptors 204 minus only the mechanical energy delivered on shaft 207. To remove this heat there is provided a closed water system in which hot water from the condenser 210 is delivered into pipe 215 and flows to titanium dioxide heat rejection panels 216 in the desert. These panels may be identical to the panels shown in FIG. 3. The cool water from panels 216 is pumped by pump 217 back to the condensor 210. This tertiary loop consisting of pipe 215, heat rejection panel 216 and pump 217 is shown as using water for the heat exchange fluid but it is within the scope of this invention to use any suitable heat exchange fluid which can operate in a closed piping system in the desert. It is also within the scope of this invention, of course, to use the secondary working fluid and pass it directly into the titanium dioxide heat rejection panels in the desert and eliminate the heat exchanger. In that case, the exhaust 209 would go directly into pipe 215 and the heat rejection panels 216 can function as the condenser for the secondary working fluid and pump 217 would be pumping condensate back to pump 211. Pump 217 would be designed for handling only the quantity of flow required and pump 211 would be designed to deliver the correct working pressure for the boiler 202.

Thus a radiactive heat rejection system has been provided.

What is claimed is:

1. In a Rankine-cycle heat engine system with a fluid condenser, means for rejecting the condenser heat comprising array of substantially horizontal panels arranged adjacent each other and exposed to visible light radiation from the sun, selective surface means on the upper side of said panel providing high reflectivity to said visible light radiation, said surface means also providing high infrared emissivity for electromagnetic radiation wave lengths in the infra-red spectrum, a heat transfer fluid, means for delivering said condenser heat to said heat transfer fluid, and thermal conduction means for carrying the thermal energy from said heat transfer fluid to said horizontal panels said large array of panels forming an effective horizontal radiation area of a plurality of acres for dissipating megawatts of thermal energy.

2. Apparatus as in claim 1 where said selective surface means includes a coating which includes a significant amount of titanium dioxide for providing for both reflection of visible light and radiation of infrared energy.

3. Apparatus as in claim 1 where said panels are closed metal boxes and said selective surface means includes a layer of titanium dioxide paint on the top of said boxes.

4. Apparatus as in claim 3 where the tops of said boxes are recessed.

5. Apparatus as in claim 1 where said heat transfer fluid is the condensate from the condenser.

6. Apparatus as in claim 1 together with a bottoming cycle turbine whose condensate is cooled.

* * * * *